US006761587B2

(12) United States Patent
Lin

(10) Patent No.: US 6,761,587 B2
(45) Date of Patent: Jul. 13, 2004

(54) CABLE CONNECTING DEVICE

(76) Inventor: Yuan Lin, 5 Viewmont Ct., Doncaster East 3109 Vic. (AU)

( * ) Notice: Subject to any disclaimer, the term of this patent is extended or adjusted under 35 U.S.C. 154(b) by 0 days.

(21) Appl. No.: 10/419,855

(22) Filed: Apr. 22, 2003

(65) Prior Publication Data

US 2003/0236029 A1 Dec. 25, 2003

(30) Foreign Application Priority Data

Jun. 21, 2002 (TW) ..... 91113691 A

(51) Int. Cl.[7] ..... H01R 9/05

(52) U.S. Cl. ..... 439/578

(58) Field of Search ..... 439/578–585, 439/1, 394, 626, 638

(56) References Cited

U.S. PATENT DOCUMENTS

| | | | | | |
|---|---|---|---|---|---|
| 5,700,160 | A | * | 12/1997 | Lee | 439/578 |
| 6,447,323 | B1 | * | 9/2002 | Watanabe | 439/371 |
| 2003/0082949 | A1 | * | 5/2003 | Parrish et al. | 439/578 |
| 2003/0129873 | A1 | * | 7/2003 | Heebe et al. | 439/578 |

* cited by examiner

*Primary Examiner*—Michael C. Zarroli
(74) *Attorney, Agent, or Firm*—Troxell Law Office PLLC

(57) ABSTRACT

A connecting device for securely connecting cables comprises a first cable, a male coupling, a male terminal assembly, a second cable, a female coupling, and a female terminal assembly. The first and second cables are threadedly secured to the male and female couplings respectively. The female coupling comprises a forward recess and a sealing ring therein. Once the male and female couplings are coupled, a sealing structure is formed as a projection of the male coupling is urged against the ring and the recess.

19 Claims, 12 Drawing Sheets

CABLE CONNECTING DEVICE

BACKGROUND OF THE INVENTION

1. Field of the Invention

The present invention relates to connecting devices and more particularly to such a device for reliably connecting a pair of cables.

2. Description of Related Art

A conventional cable connecting device is shown in FIGS. 10, 11 and 12. It comprises a male coupling 1, a female coupling 2, a male fastening element 3, a female fastening element 4, a plastic shield of first cable 5, a plastic shield of second cable 6, a first coupling 7, a second coupling 8, and a union 9. Each of above components will now be described in detail below.

The plastic shield of second cable 6 has a forward end inserted into the female coupling 2. The plastic shield of second cable 6 comprises two apertures 6C in the forward end for receiving the female fastening element 4 and thus connecting together conductors 6*a* of the second cable and the female fastening element 4. The female coupling 2 has outer peripheral ridges 2*b* in the rear end. The second coupling 8 has an inner thread 8*a* tapered toward the rear as seen from FIG. 10. Hence, a tight coupling between the second coupling 8 and the female coupling 2 is carried out as the outer thread 2*b* is inserted into the second coupling 8 for securing to the plastic shield of second cable 6. Also, the female coupling 2 has an outer thread 2*c* in the forward end.

The union 9 comprises an inner thread 9*a* put on the male coupling 1. The plastic shield of first cable 5 has a forward end inserted into the male coupling 1. The plastic shield of first cable 5 comprises two apertures 5C in the forward end for receiving the male fastening element 3 and thus connecting together conductors 5*a* of the first cable and the male fastening element 3. The male coupling 1 has an outer thread 1*a* in the rear end. The first coupling 7 has an inner thread 7*a* tapered toward the rear as seen from FIG. 10. The union 9 is secured around the outer thread 2*c* of the female coupling 2 and the female fastening element 4 are inserted into apertures 3*a* in the forward end of the male fastening element 3 for coupling. Hence, a tight coupling between the first coupling 7 and the male coupling 1 is carried out as the inner peripheral ridges 1*b* secured to the plastic shield of first cable 5. This completes a connection of cables.

However, the prior art cable connecting device suffered from several disadvantages. For example, a securing force of the inner peripheral ridges 1*b* exerted on the plastic shield of first cable 5 is vertical and not sufficient. Hence, such securing is not reliable. Further, a tensile strength of the cables is not sufficient in a practical use. Likewise, a securing force between the female coupling 2 and the plastic shield of second cable 6 is not reliable. Furthermore, the well-known cable connecting device consists of many loose parts (e.g., the male coupling 1, the female coupling 2, the male fastening element 3, the female fastening element 4, the plastic shield of first cable 5, the plastic shield of second cable 6, the first coupling 7, the second coupling 8, and the union 9) that have to be assembled by the user. Hence, it is expensive to produce and time consuming to assemble. Moreover, the prior art is not waterproof. In detail, water can penetrate through gaps between the inner peripheral ridges 1*b* of the male coupling 1 and the plastic shield of first cable 5. Also, moisture generated by the penetrated water will cause short circuit or rust in the male fastening element 3. This also occurs between the female coupling 2 and the plastic shield of second cable 6. In addition, the first coupling 7, the second coupling 8, and the union 9 are threaded parts. Hence, they are susceptible to being disengaged from the male coupling 1 and the female coupling 2. That is, the securing between the male coupling 1 and the female coupling 2 is not reliable. This in turn deteriorates the water penetration problem as well as significantly decreases the tensile strength of the cables. Thus improvement exists.

SUMMARY OF THE INVENTION

It is an object of the present invention to provide a device for connecting cables having the following advantages. At least one waterproof means is provided. This is advantageous over the prior art. An external force is applied in the same direction as that of a tensility of the invention. Hence, a tensile strength of the invention is advantageous over the prior art. A pair of terminals are provided for ease of tightly coupling together. The invention is designed to comply with a safety rule stipulated by the government. Hence, a coupling of a male coupling and a female coupling is reliable. This is best illustrated in second and third preferred embodiments in which a tool is required to disengage one from the other. This is also advantageous over the prior art. The invention has less constituent components so as to simplify an assembly and reduce a manufacturing cost. A simple, quick assembly is feasible. This is also advantageous over the prior art. A waterproof member is provided either between the male coupling and a first cable or between the female coupling and a second cable. Thus, three waterproof means are provided for enhancing a waterproofing between the male coupling and the first cable and between the female coupling and the second cable.

The above and other objects, features and advantages of the present invention will become apparent from the following detailed description taken with the accompanying drawings.

DETAILED DESCRIPTION OF THE PREFERRED EMBODIMENTS

Figure 1:
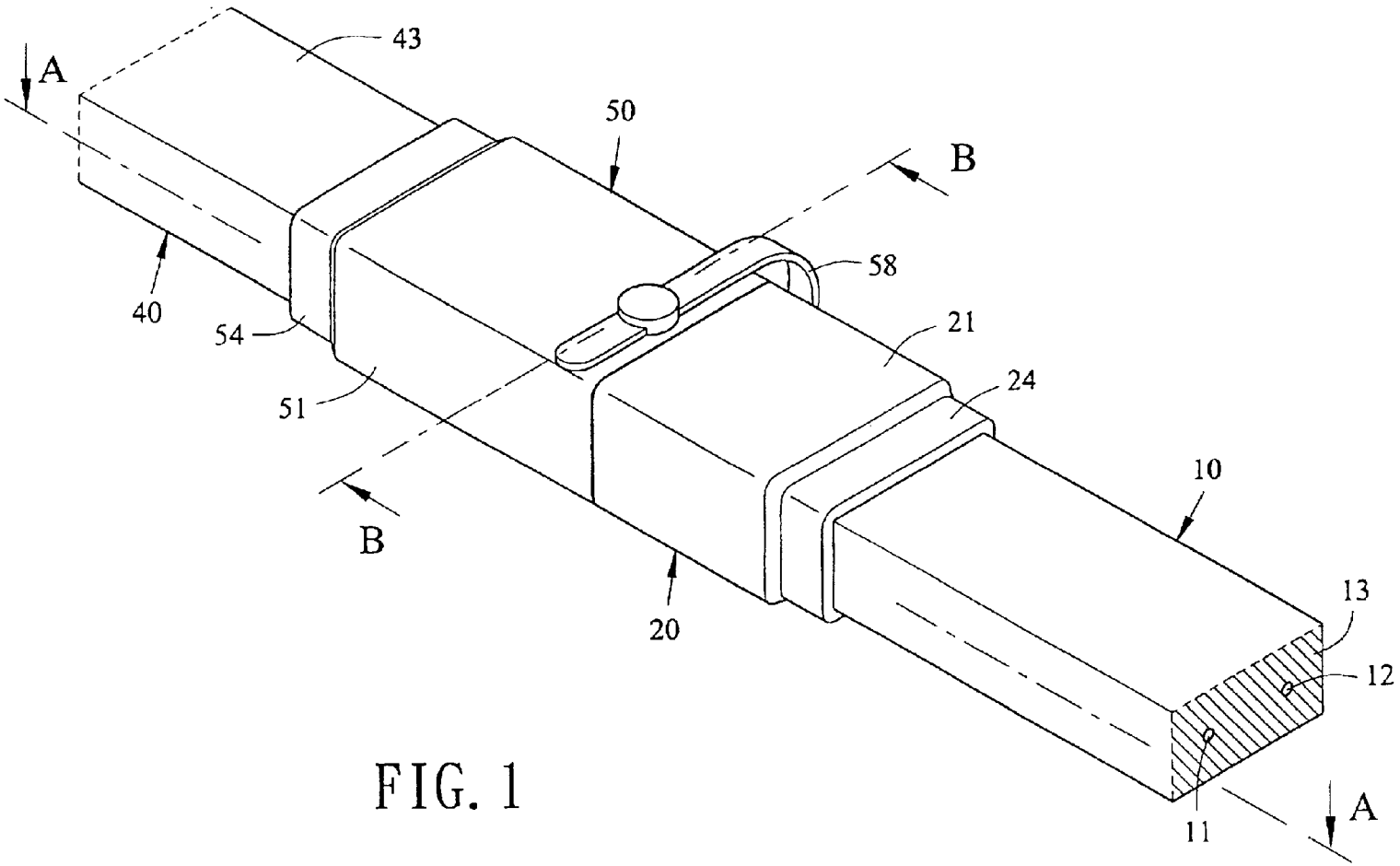
FIG. 1 is a perspective view of a first preferred embodiment of a device for connecting cables according to the invention.

Referring to FIGS. 1 to 4, there is shown a first preferred embodiment of a device for connecting cables constructed in accordance with the invention. The device comprises a first cable 10, a male coupling 20, a male terminal assembly 30, a second cable 40, a female coupling 50, and a female terminal assembly 60. Each of above components will now be described in detail below.

The first cable 10 is formed by extruding process and comprises a pair of parallel conductors 11, 12 and a shield 13 enclosed the conductors 11, 12. The male coupling 20 comprises a first shell 21, a first sealing ring 22, a flange 24 in the rear end of the first shell 21, a space 26 within the first shell 21 for passing the first cable 10, a projection 23 in the forward end of the first shell 21, a peripheral groove 25 around the projection 23 with the first sealing ring 22 fastened around, two parallel channels 27 (see FIGS. 3 and 4) within the projection 23, two lengthwise apertures 270 extended from the channels 27 into the space 26 (see FIGS. 2A and 3), a rib 28 between the channels 27, and a hole 280 (see FIG. 4) through the first shell 21.

Figure 2A:
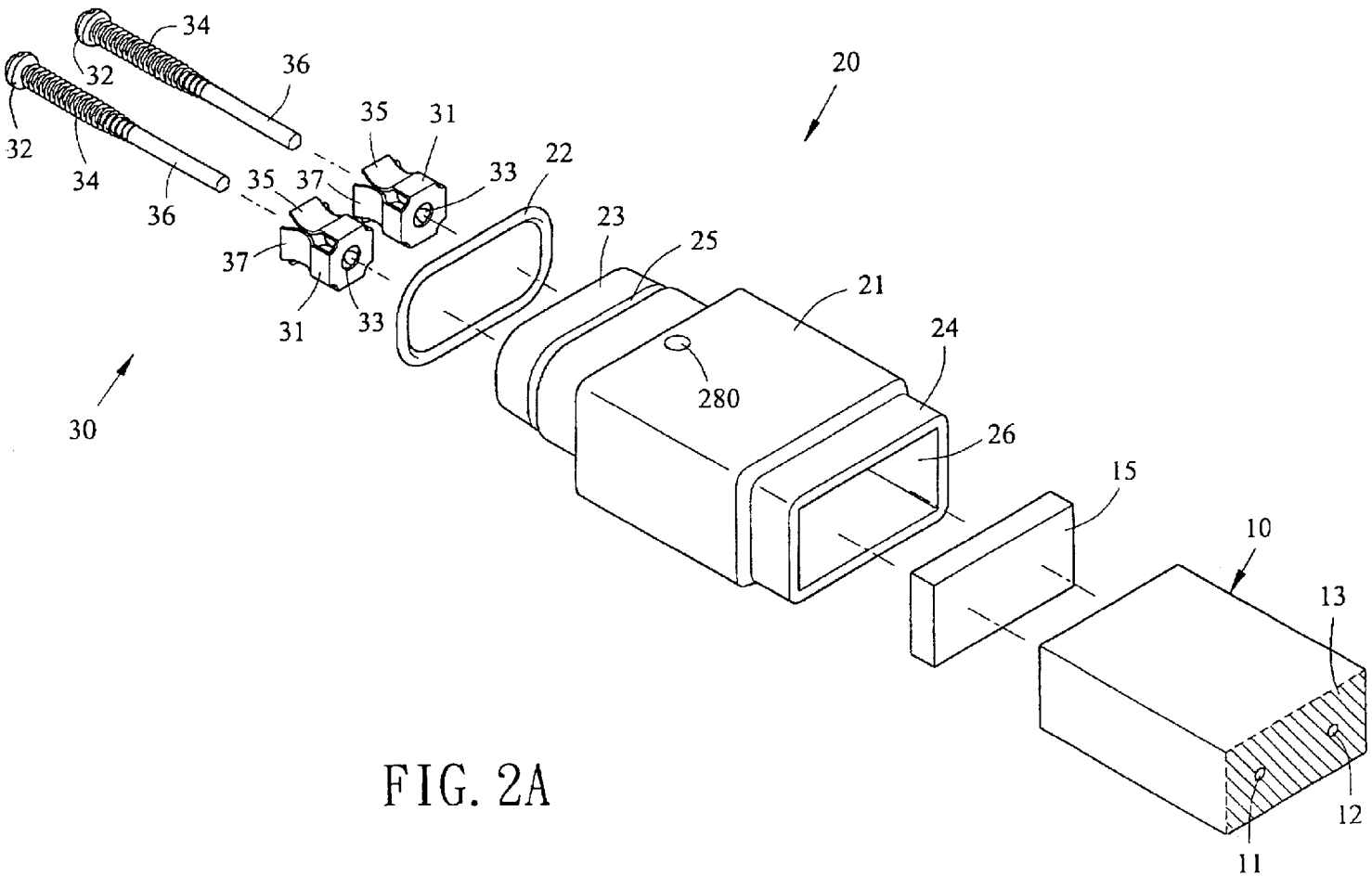
FIGS. 2A and 2B are exploded views of the FIG. 1 device.
Figure 3:
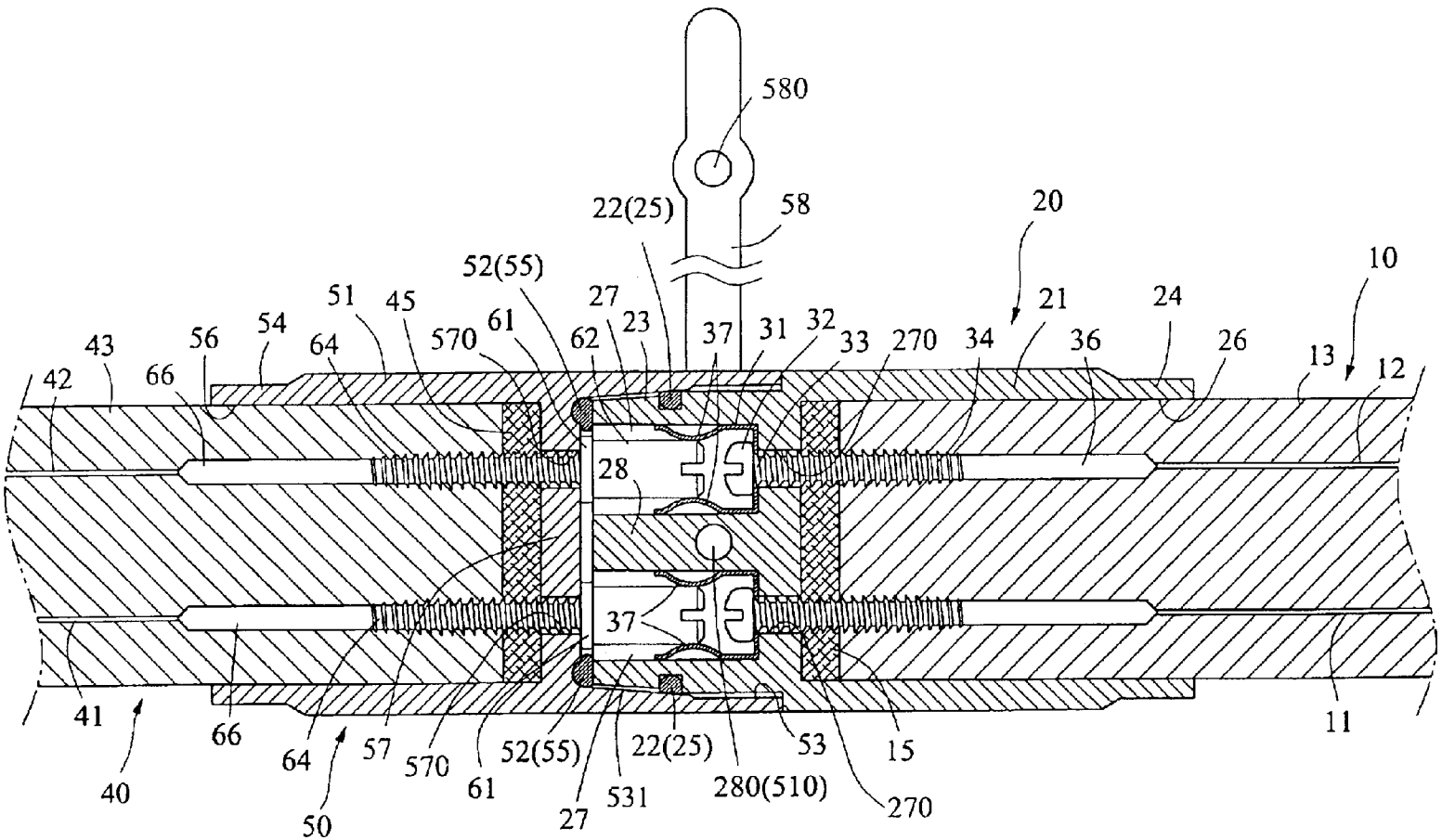
FIGS. 3 and 4 are cross-sectional views taken along lines A—A and B—B of FIG. 1 respectively.

As shown in FIG. 2A, the male terminal assembly 30 comprises two pairs of male terminals 31 and first bolts 32 both placed in the channels 27 of the first shell 21. The male terminal 31 is formed of metal and is substantially shaped as a cup. The male terminal 31 comprises a hole 33 provided in the bottom for permitting the first bolt 32 to pass through, two opposite first elastic wings 35, and two opposite second elastic wings 37 between the first elastic wings 35 as shown in FIG. 3, the first bolts 32 are inserted through the apertures 270 to contact the conductors 11, 12 respectively with threads 34 secured to the shield 13 of the first cable 10. The first cable 10 is in turn secured in the space 26 of the first shell 21. Thus, an external force may be applied in the same direction as that of a tensility of the device. Also, the male terminals 31 are secured in the channels 27.

Likewise, the second cable 40 is formed by extruding process and comprises a pair of parallel conductors 41, 42 and a shield 43 enclosed the conductors 41, 42. The female coupling 50 comprises a second shell 51, a second sealing ring 52, a flange 54 in the rear end of the second shell 51, a space 56 (see FIG. 3) within the second shell 51 for passing the second cable 40, a recess 53 in the forward end of the second shell 51, two parallel apertures 570 extended from an inner wall 57 of the recess 53 into the space 56, a peripheral groove 55 (see FIG. 3) at a junction of the recess 53 and the wall 57 with the second sealing ring 52 fastened around, two holes 510 on a top and a bottom of the second shell 511 respectively, a clip 58 extended from the second shell 51, and a stud 580 near the open end of the clip 58 inserted into the holes 510 for fastening.

Figure 2B:
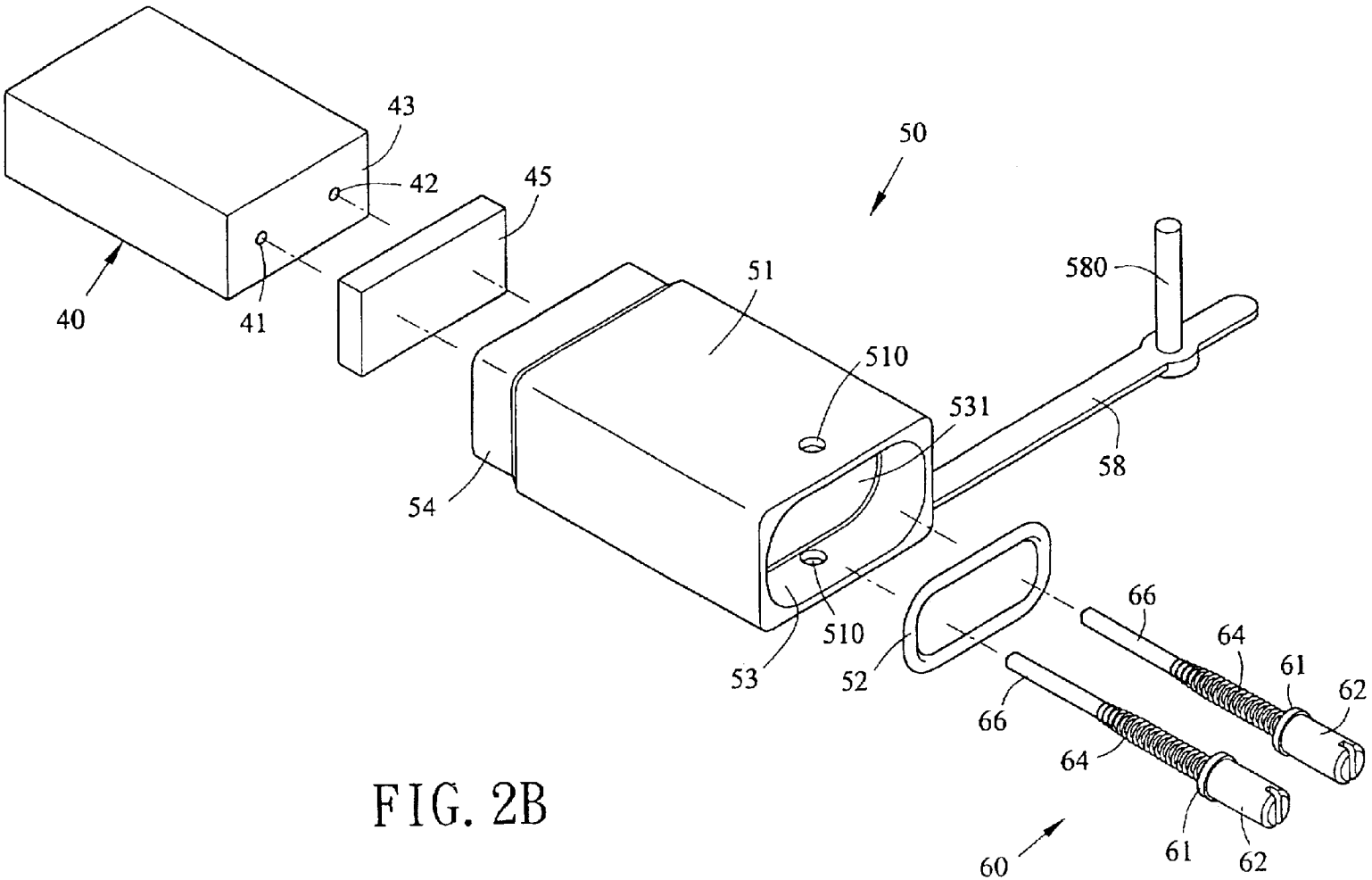

As seen in FIGS. 2B and 3, the female terminal assembly 60 comprises a pair of second bolts 61. An elongate head 62 of the bolt 61 is formed as a contact. The second bolts 61 are inserted through the apertures 570 to contact the conductors 41, 42 respectively with threads 64 secured to the shield 43 of the second cable 40. The second cable 40 is in turn secured in the space 56 of the second shell 51. Thus, an external force may be applied in the same direction as that of a tensility of the device.

Figure 4:
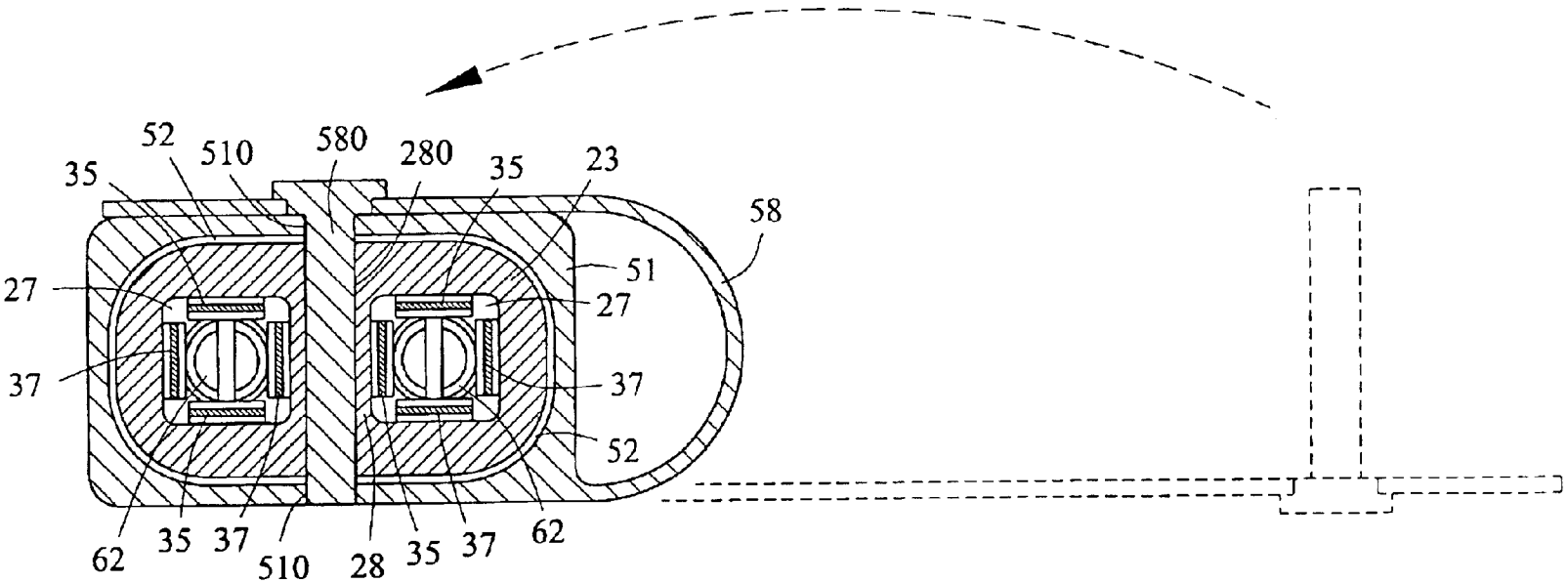

As best seen from FIGS. 3 and 4, in an assembly of the male coupling 20 and the female coupling 50, the projection 23 of the first shell 21 is inserted into the recess 53 of the second shell 51. Heads 62 of the second bolts 61 are inserted through the channels 27 of the first shell 21 to be fastened by the elastic wings 35, 37. At the same time, a first sealing structure is formed as the projection 23 of the first shell 21 is pressed around the second sealing ring 52. Further, a second sealing structure is formed as inner surface of the recess 53 of the second shell 51 is pressed against the first sealing ring 22. This configuration can increase quality and prolong a useful life of the device.

Referring to FIG. 3 specifically, it is seen that a force of the projection 23 of the first shell 21 exerted on the second sealing ring 52 is axially. Hence, the first sealing structure is reliable. Further, first bolts 32 are driven to secure to the shield 13 of the first cable 10. A diameter of the thread 34 is larger than that of either conductor 11 or 12. Thus, the thread 34 can secure to the shield 13 so that an external force may be applied in the same direction as that of a tensility of the device. Also, the shield 13 is slightly enlarged as the insertion of the thread 34. This in turn to cause the shield 13 to tightly engage with an inner surface of the space 26 of the first shell 21. Likewise, a tight engagement between the second bolt 61 and the space 56 of the second shell 51 is effected.

Referring to FIG. 4 specifically, the stud 580 of the female coupling 50 is inserted into the holes 510 of the second shell 51 and the hole 280 of the first shell 21 for securing the male coupling 20 and the female coupling 50 together. This in turn enhances two sealing structures.

As shown in FIG. 3, it is noted that the elastic wings 35, 37 are provided for clamping the head 62 of the second bolt 61 in order to secure to the male terminal 31. Further, a forward extension 36 may be formed in the thread 34 for facilitating an insertion of the first bolt 32 into the shield 13 of the first cable 10 for securing. The extension 36 can press against the conductors 11, 12 to a maximum degree for further enhancing a fastening. Likewise, a forward extension 66 having the same characteristics may be formed in the thread 64. Furthermore, a sharp point may be formed in the open end of the extension 36 of the first bolt 32 for facilitating an insertion of the first bolt 32 into the shield 13 of the first cable 10 for securing. Such sharp point effects a more precise insertion of the first bolt 32 into the shield 13. Likewise, a sharp point may be formed in the extension 66 of the second bolt 61. Moreover, the recess 53 of the second shell 51 has a flat or tapered inner surface. In a case that it is a flat inner surface a first tapered surface 531 and a continuous second tapered surface are formed within the recess 53. In brief, the second sealing structure of the invention aims at pressing the recess of the second shell 51 against the first sealing ring 22. In addition, a waterproof member 15 formed of a kind of elastic material, such as EVA foam or silicone rubber can be provided inside the space 26. The first cable 10 is urged against the waterproof member 15 as the first bolt 32 is secured to the shield 13 of the first cable 10. Also, the waterproof member 15 is urged against a bottom of the space 26. This can effect a waterproofing between the male coupling 20 and the first cable 10. Likewise, a waterproof member 45 can be provided inside the space 56 doing the same function same as the waterproof member 15, as mentioned above. This also can effect a waterproofing between the female coupling 50 and the second cable 20.

Figure 5:
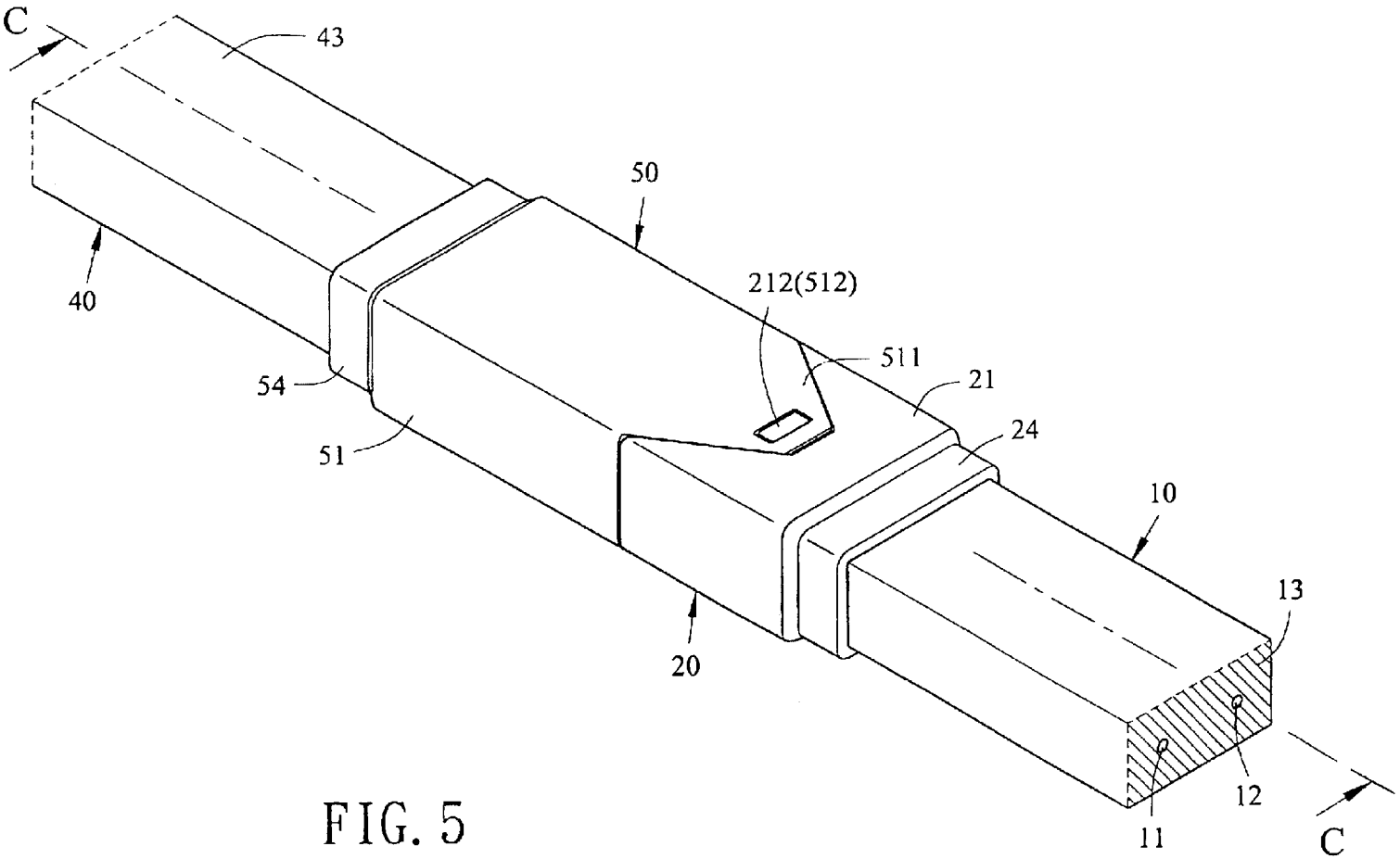
FIG. 5 is a perspective view of a second preferred embodiment of a device for connecting cables according to the invention.
Figure 6:
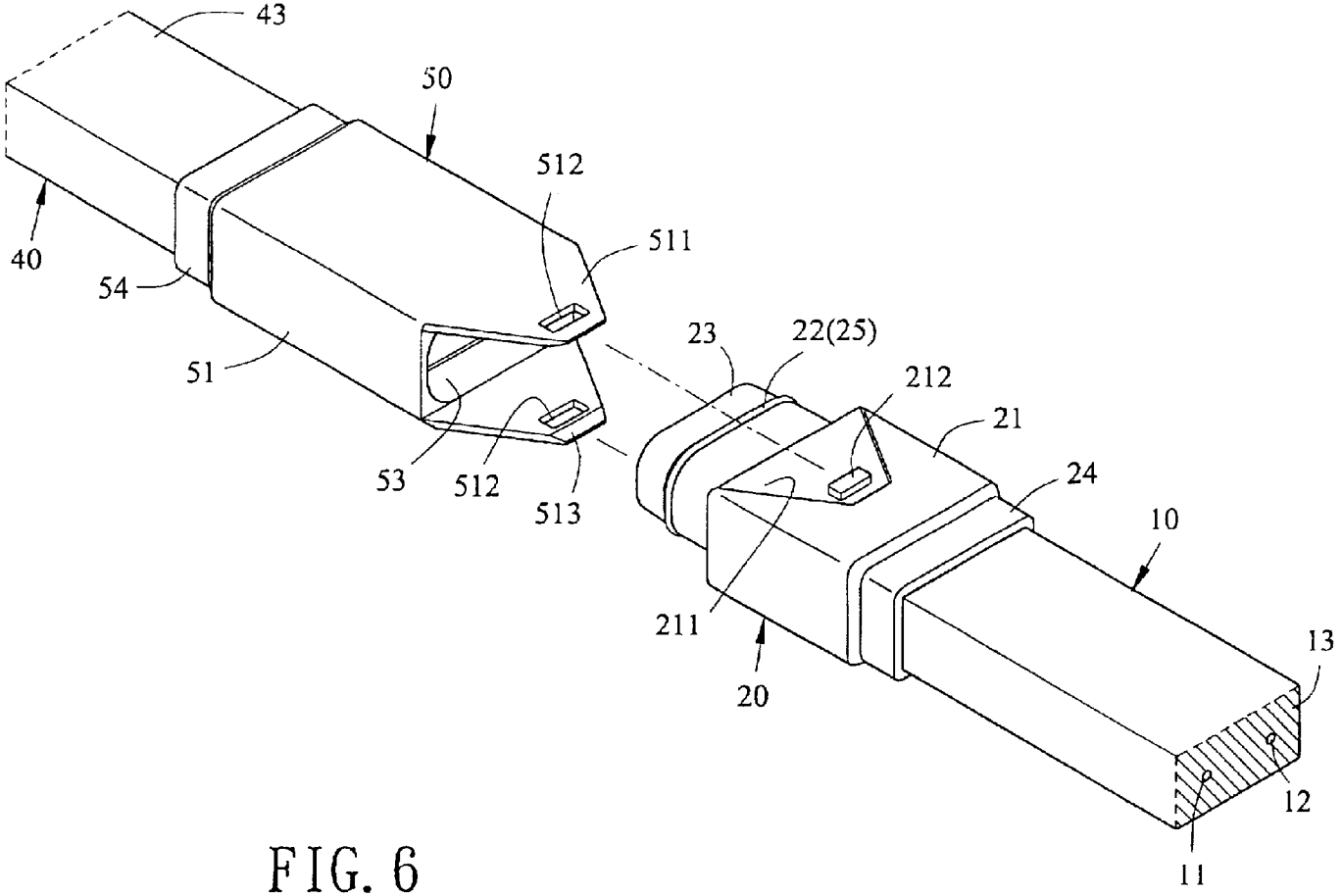
FIG. 6 is an exploded view of the FIG. 5 device.
Figure 7:
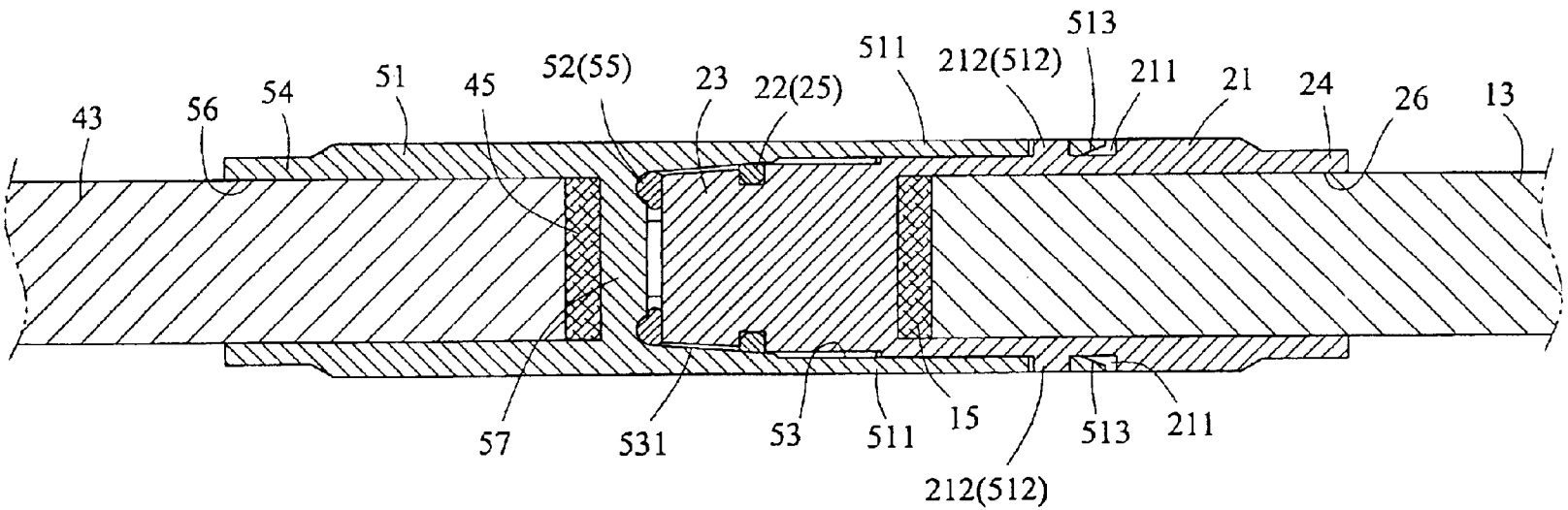
FIG. 7 is a cross-sectional view taken along line C—C of FIG. 5.

Referring to FIGS. 5 to 7, there is shown a second preferred embodiment of the invention. The differences between the first and the second preferred embodiments are detailed below. In the male coupling 20 the hole 280 (see FIG. 3) in the first preferred embodiment is eliminated. Top and bottom recessed portions 211 are formed. Finally, a tab 212 is formed in each of the top and bottom recessed portions 211. In the second shell 51, the holes 510, the clip 58, and the stud 580 (see FIG. 3) in the first embodiment are also eliminated. Top and bottom protrusions 511 are formed for matingly securing to the top and the bottom recessed portions 211 respectively. A slit 512 is formed in each of the top and bottom protrusions 511. Finally, a slanted surface 513 is formed on an inner surface of each of the top and bottom protrusions 511 in front of the slit 512.

In an assembly of the male coupling 20 and the female coupling 50, the projection 23 of the first shell 21 is inserted into the recess 53 of the second shell 51 and the protrusions 511 of the second shell 51 are secured onto the recessed portions 211 as the slanted surfaces 513 are passed through the tabs 212 to cause the tabs 212 to insert in the slits 512. Such fastening is simple and quick. Further, components are simplified. Note that a shape of either protrusion 511 or recessed portion 211 may be a V shape configuration. Further, a straight or curved side can be formed in the junction of bifurcation of the V shape configuration.

Figure 8:
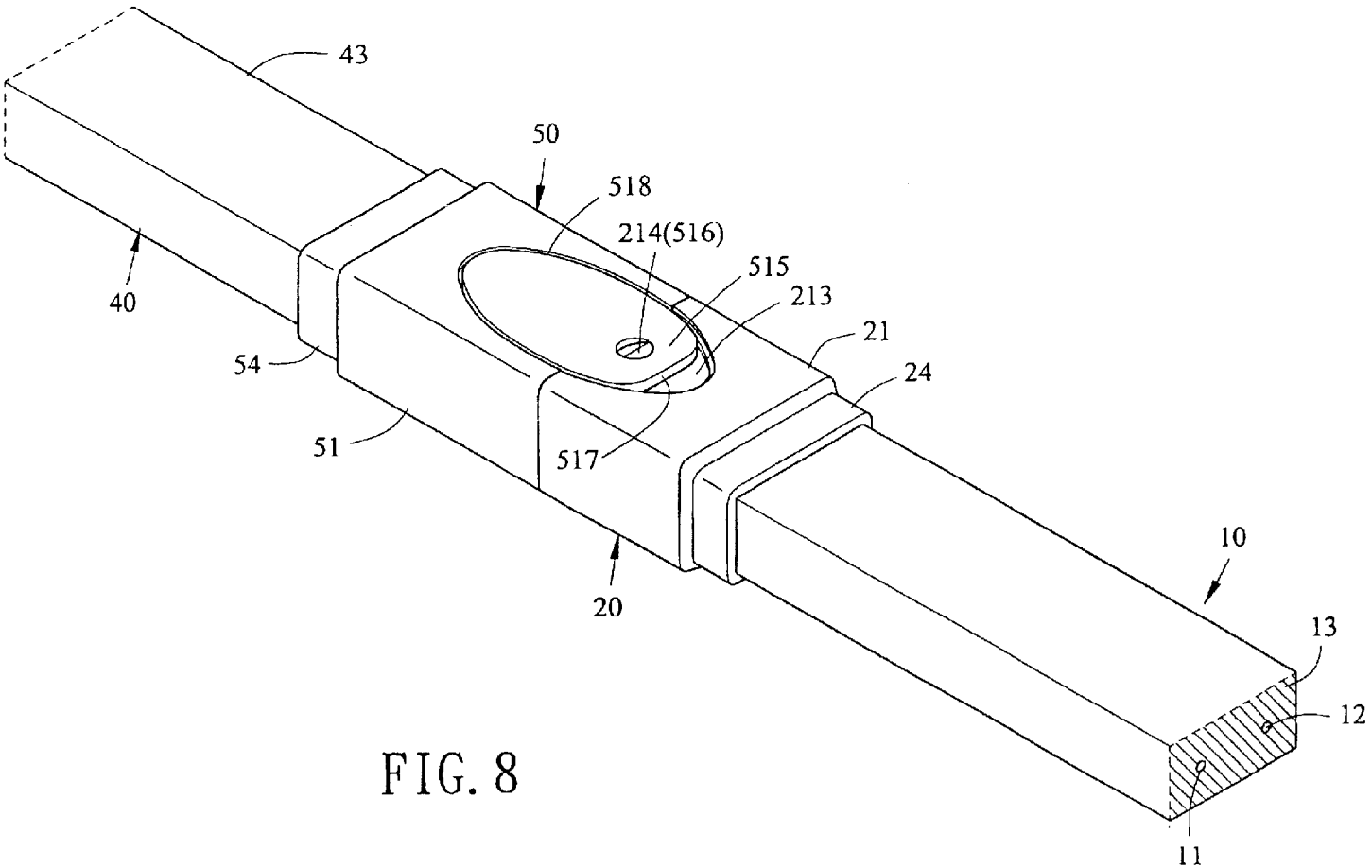
FIG. 8 is a perspective view of a third preferred embodiment of a device for connecting cables according to the invention.
Figure 9:
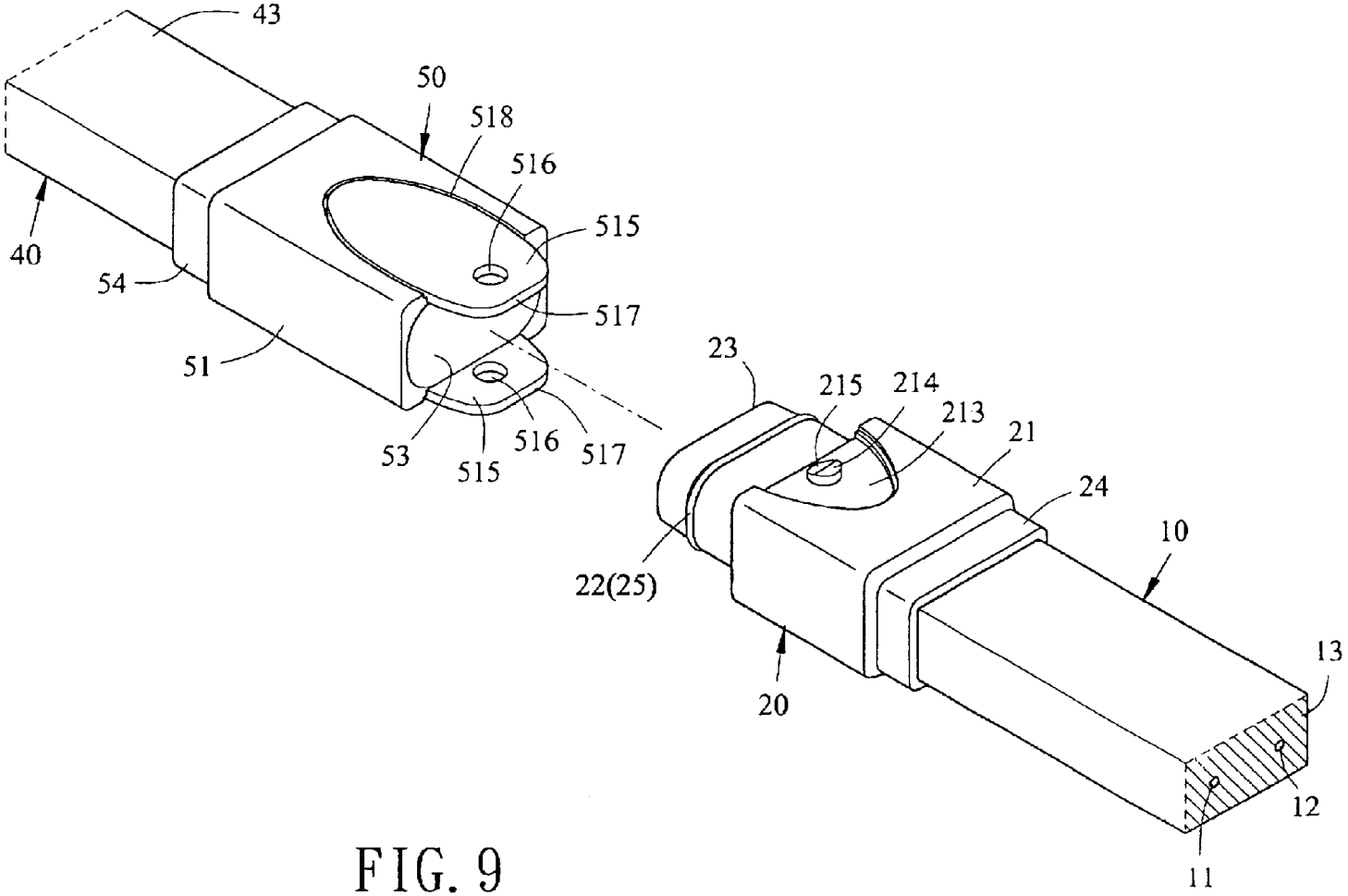
FIG. 9 is an exploded perspective view of the FIG. 8 device.
Figure 10:
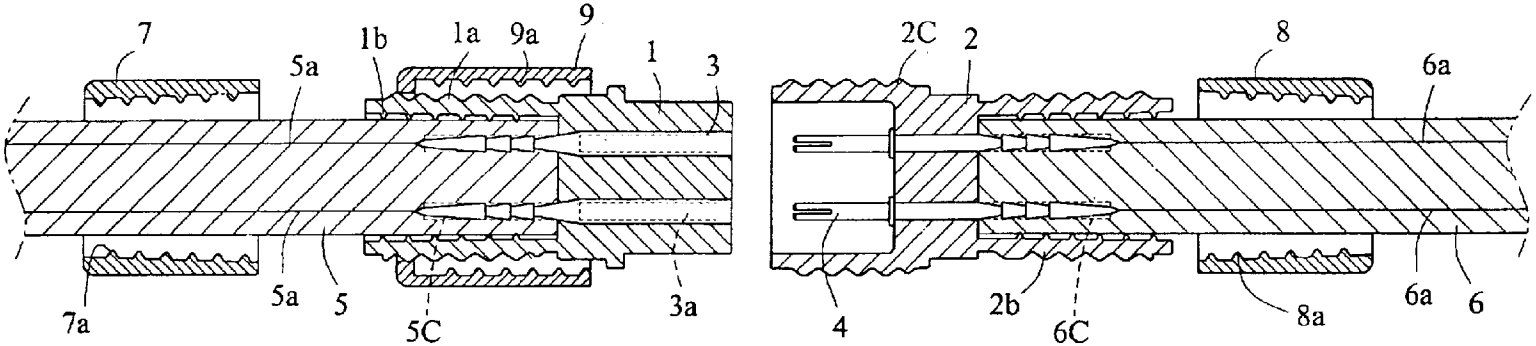
FIG. 10(PRIOR ART)
FIGS. 10, 11, and 12 are cross-sectional views of a conventional device for connecting cables before assembled, after assembled, and secured respectively.
Figure 11:
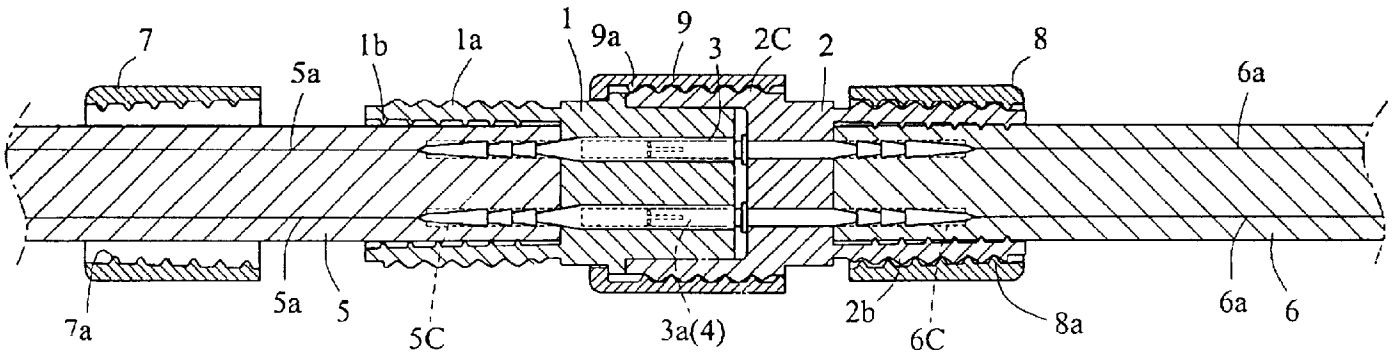
FIG. 11(PRIOR ART)
Figure 12:
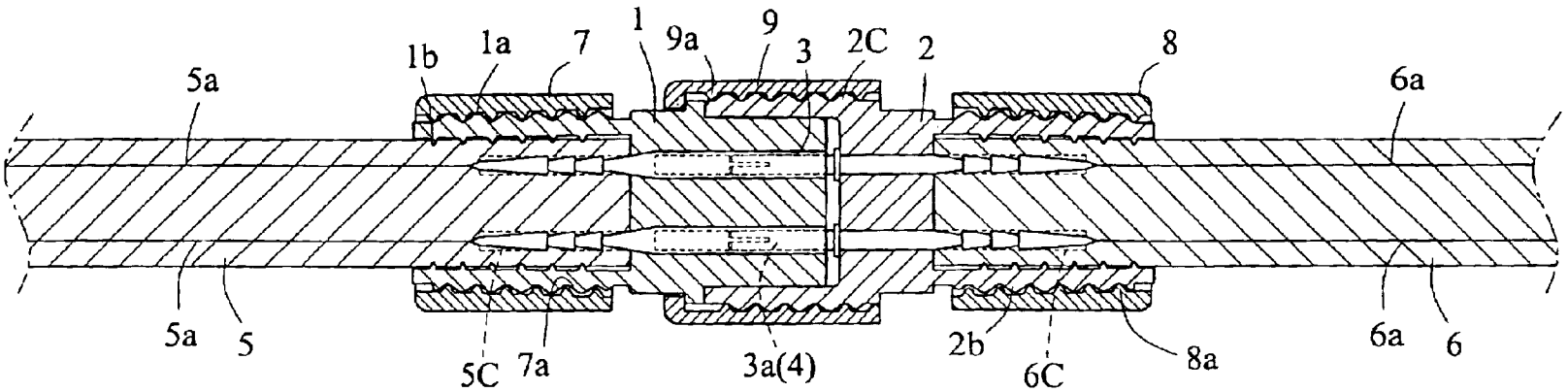
FIG. 12(PRIOR ART)

Referring to FIGS. 8 and 9, there is shown a third preferred embodiment of the invention. The differences between the second and the third preferred embodiments are detailed below. In the first shell 21 top and bottom recessed portions 213 having a shape of about a portion of oval are formed. A tab 214 is formed in each of the top and bottom recessed portions 213. Finally, a slanted surface 215 is formed on the front top of the tab 214. In the second shell 51, top and bottom protrusions 515 are formed for matingly securing to the top and the bottom recessed portions 213 respectively. Finally, a hole 516 is formed in each of the top and bottom protrusions 515.

In an assembly of the male coupling 20 and the female coupling 50, the projection 23 of the first shell 21 is inserted into the recess 53 of the second shell 51 and the protrusions 515 of the second shell 51 are secured onto the recessed portions 213 of the first shell 21 as the forward ends of the protrusions 515 are passed through the slanted surfaces 215 to cause the tabs 214 to be easily inserted in the holes 516. Such fastening is also simple and quick.

As shown in FIG. 8, the forward end of either protrusion 515 may be formed as a straight line 517 or a curved one. As such, a gap is formed between the flat end 517 and the recessed portion 213 after the protrusions 515 is secured onto the recessed portions 213. Hence, a user can use a tool to insert in the gap for disengaging the protrusions 515 from the recessed portions 213. Moreover, a curved trough 518 is formed on a portion of periphery of each protrusion 515 so that the trough 518 and the recessed portion 213 can form an oval after the protrusions 515 is secured onto the recessed portions 213. This is aesthetic.

The benefits of this invention include:

(1) As to waterproofing, at least one waterproof means is provided. This is advantageous over the prior art. A force of the projection 23 of the first shell 21 exerted on the second sealing ring 52 is axially. Hence, the first sealing structure is reliable. Further, a second sealing structure is formed as inner surface of the recess 53 of the second shell 51 is pressed against the first sealing ring 22. This configuration is also highly waterproof.

(2) As to tensile strength, an external force is applied in the same direction as that of a tensility of the invention. Hence, a tensile strength of either cable 10 or 40 is advantageous over the prior art. The first bolts 32 are inserted through the apertures 270 to contact the conductors 11, 12 respectively with threads 34 secured to the shield 13 of the first cable 10. The first cable 10 is in turn secured in the space 26 of the first shell 21. Thus, an external force may be applied in the same direction as that of a tensility of the device. Also, the second bolts 61 are inserted through the apertures 570 to contact the conductors 41, 42 respectively with threads 64 secured to the shield 43 of the second cable 40. The second cable 40 is in turn secured in the space 56 of the second shell 51. Thus, an external force may be applied in the same direction as that of a tensility of the device.

(3) As to connecting capability, a pair of terminals are provided for ease of tightly coupling together. The heads 62 of the second bolts 61 are inserted through the channels 27 of the first shell 21 to be fastened by the elastic wings 35, 37 of the male terminal 31.

(4) As to safety, the invention is designed to comply with a safety rule stipulated by the government. Hence, the stud 580 of the female coupling 50 is inserted into the holes 510 of the second shell 51 and the hole 280 of the first shell 21 for securing the male coupling 20 and the female coupling 50 together. Referring to the second embodiment specifically, the top and the bottom protrusions 511 are formed for matingly securing to the top and the bottom recessed portions 211 of the first shell 21. Thus, the male coupling 20 and the female coupling 50 are secured. In disassembly, a user has to use a tool to disengage the protrusions 515 from the recessed portions 213. Likewise, in disassembling the secured the protrusions 515 and the recessed portions 213, a user has to use a tool to disengage the protrusions 515 from the recessed portions 213. This is highly safe.

(5) As to a simplification of components, except the first and the second cables 10, 40, the device only incorporates the male coupling 20, the male terminal assembly 30, the female coupling 50, and the female terminal assembly 60. Thus, the invention has less constituent components so as to simplify an assembly and reduce a manufacturing cost.

(6) As to coupling, a simple, quick assembly is feasible. In the second embodiment, in an assembly of the male coupling 20 and the female coupling 50, the projection 23 of the first shell 21 is inserted into the recess 53 of the second shell 51 and the protrusions 511 of the second shell 51 are secured onto the recessed portions 211 as the slanted surfaces 513 are passed through the tabs 212 to cause the tabs 212 to be easily inserted in the slits 512. Such fastening is simple and quick. Likewise, in the third embodiment, in an assembly of the male coupling 20 and the female coupling 50, the projection 23 of the first shell 21 is inserted into the recess 53 of the second shell 51 and the protrusions 515 of the second shell 51 are secured onto the recessed portions 213 of the first shell 21 as the forward ends of the protrusions 515 are passed through the slanted surfaces 215 to cause the tabs 214 to be easily inserted in the holes 516. Such fastening is also simple and quick.

Note that in FIG. 4 a section of either the male coupling 20 or the female coupling 50 is a rectangle if that of the first cable 10 or the second cable 40 is a rectangle. This is also true in the second and third embodiments. Likewise, a section of either the male coupling 20 or the female coupling 50 is an oval or circle if that of the first cable 10 or the second cable 40 is an oval or circle. This is also true in the second and third embodiments.

While the invention herein disclosed has been described by means of specific embodiments, numerous modifications and variations could be made thereto by those skilled in the art without departing from the scope and spirit of the invention set forth in the claims.

What is claimed is:

1. A cable connecting device comprising:

a first cable comprising a pair of parallel first conductors and a first shield enclosing the first conductors;

a male coupling comprising a first shell, a first flange in a rear end of the first shell, a first space within the first shell for passing the first cable, a projection in a forward end of the first shell, a peripheral first groove around the projection with a first sealing ring fastened around, two parallel channels provided within the projection, a pair of lengthwise first apertures each extending from the channel into the first space;

a male terminal assembly comprising two pairs of male terminals and first threaded bolts both place in the channels, the male terminal comprising a bottom hole for permitting the first threaded bolt to pass through, and two opposite first elastic wings, the first threaded bolts being inserted through the first apertures to contact the first conductors respectively to threadedly secure to the first shield, the first cable being secured in the first space, and the male terminals being secured in the channels;

a second cable comprising a pair of parallel second conductors and a second shield enclosing the second conductors;

a female coupling comprising a second shell, a second flange in a rear end of the second shell, a second space within the second shell for passing the second cable, a recess in a forward end of the second shell, two parallel second apertures extended from an inner wall of the recess into the second space, a peripheral second groove at a junction of the recess and the inner wall of the recess with a second sealing ring fastened around, two second holes each provided on a top and a bottom of the second shell respectively, a clip extended from the second shell, and a stud near an open end of the clip inserted into the second holes for fastening; and a female terminal assembly comprising a pair of second threaded bolts each being inserted through the second apertures to contact the second conductors to threadedly secure to the second shield, and the second cable being secured in the second space;

wherein in an assembly of the male and the female couplings, the projection of the male coupling is inserted into the recess of the female coupling, a head of each second threaded bolt is inserted through the respective channel to be fastened by the first elastic wing, a first sealing structure is formed as the projection is pressed around the second sealing ring, a second sealing structure is formed as an inner surface of the recess is pressed against the first sealing ring, and the stud is inserted into the second and the first holes for securing the male and female couplings together.

2. The cable connecting device of claim 1, the male terminal assembly further comprises two opposite second elastic wings between the first elastic wings.

3. The cable connecting device of claim 1, wherein a thread of each of the first threaded bolts comprises a first extension having a sharp end and a thread of each of the second threaded bolts comprises a second extension having a sharp end.

4. The cable connecting device of claim 1, wherein the recess comprises a first tapered surface and a continuous second tapered surface therein.

5. The cable connecting device of claim 1, further comprising a first waterproof member within the first space being urged against a bottom of the first space by the first cable and a second waterproof member within the second space being urged against a bottom of the second space by the second cable.

6. The cable connecting device of claim 5, wherein each of the waterproof members is formed of plastic or rubber elastic material, such as a silicone rubber.

7. The cable connecting device of claim 1, wherein a section of either the male of the female coupling is a rectangle, oval, or circle as that of the first or the second cable.

8. A cable connecting device comprising:

a first cable comprising a pair of parallel first conductors and a first shield enclosing the first conductors;

a male coupling comprising a first shell, a first flange in a rear end of the first shell, a first space within a first shell for passing the first cable, a projection in a forward end of the first shell, a peripheral first groove around the projection with a first sealing ring fastened around, two parallel channels provided within the projection, a pair of lengthwise first apertures each extended from the respective channel into the first space, a rib between the channels, top and bottom recessed portions, and a tab in each of the top and the bottom recessed portions;

a male terminal assembly comprising two pairs of male terminals and first threaded bolts both placed in the channels, the male terminal comprising a bottom hole for permitting the first threaded bolt to pass through, and two opposite first elastic wings, the first threaded bolts being inserted through the first apertures to contact the first conductors respectively to threadedly secure to the first shield, the first cable being secured in the first space, and the male terminals being secured in the channels;

a second cable comprising a pair of parallel second conductors and a second shield enclosing the second conductors;

a female coupling comprising a second shell, a second flange in a rear end of the second shell, a second space within the second shell for passing the second cable, a recess in a forward end of the second shell, two parallel second apertures extended from an inner wall of the recess into the second space, a peripheral second groove at a junction of the recess and the inner wall of the recess with a second sealing ring fastened around, top and bottom protrusions, and a slit in each of the top and bottom protrusions; and a female terminal assembly comprising a pair of second threaded bolts each being inserted through the second apertures to contact the second conductors to threadedly secure to the second shield, and the second cable being secured in the second space;

wherein in an assembly of the male and the female coupling a head of each second threaded bolt is inserted through the respective channel to be fastened by the first elastic wings, a first sealing structure is formed as the projection is pressed around the second sealing ring, a second sealing structure is formed as an inner surface of the recess is pressed against the first sealing ring, the projection of the male coupling is inserted into the recess of the female coupling, and the top and the bottom protrusions are matingly secured onto the top and the bottom recessed portions as the top and the bottom protrusions are passed through the tabs to cause the tabs to insert in the slits.

9. The cable connecting device of claim 8, wherein the male terminal assembly further comprises two opposite second elastic wings between the first elastic wings.

10. The cable connecting device of claim 8, wherein a thread of each of the first threaded bolts comprising a first extension having a sharp end and a thread of each of the second threaded bolts comprises a second extension having a sharp end.

11. The cable connecting device of claim 8, wherein the recess comprises a first tapered surface and a continuous second tapered surface therein.

12. The cable connecting device of claim 8, further comprising a first waterproof member within the first space being urged against a bottom of the first space by the first cable and a second waterproof member within the second space being urged against a bottom of the second space by the second cable.

13. The cable connecting device of claim 12, wherein each of the waterproof members is formed of plastic or rubber elastic material, such as a silicone rubber.

14. The cable connecting device of claim 8, wherein a section of either the male or the female coupling is a rectangle, oval, or circle as that of the first or the second cable.

15. The cable connecting device of claim 8, wherein a shape of each of the top and the bottom protrusions or each of the top and the bottom recessed portions is a V shape configuration having a straight or curved bottom.

16. The cable connecting device of claim 8, wherein a shape of each of the top and the bottom protrusions and that of a corresponding one of the top and the bottom recessed portions is an oval in combination.

17. The cable connecting device of claim 8, wherein each of the top and the bottom protrusions comprises a slanted surface on an inner surface in front of the slit.

18. The cable connecting device of claim 8, wherein each of the top and bottom recessed portions comprises a slanted surface on an inner surface in front of the slit.

19. The cable connecting device of claim 8, wherein each of the tabs comprises a slanted top surface.

* * * * *